United States Patent [19]

Kenyon et al.

[11] Patent Number: 4,970,028

[45] Date of Patent: Nov. 13, 1990

[54] COMPOSITION FOR SOFTENING FABRICS

[75] Inventors: Ian R. Kenyon, Merseyside, United Kingdom; Bryan C. Smith, Rotterdam, Netherlands

[73] Assignee: Lever Brothers Company, New York, N.Y.

[21] Appl. No.: 247,971

[22] Filed: Sep. 22, 1988

[30] Foreign Application Priority Data

Sep. 24, 1987 [GB] United Kingdom ..... 8722540

[51] Int. Cl.[5] ..... C11D 1/18

[52] U.S. Cl. ..... 252/544; 252/8.8; 252/525

[58] Field of Search ..... 252/8.75, 8.8, 99, 525, 252/528, 544, 547

[56] References Cited

U.S. PATENT DOCUMENTS 4,292,035 9/1981 Battrell ..... 252/8.8
4,338,204 7/1982 Spadin et al. ..... 252/8.75

FOREIGN PATENT DOCUMENTS 011340 5/1980 European Pat. Off. .
087914A 9/1983 European Pat. Off. .
199403A 10/1986 European Pat. Off. .
203660A 12/1986 European Pat. Off. .
206375A 12/1986 European Pat. Off. .
1241754 8/1971 United Kingdom .
1514276 6/1978 United Kingdom .

OTHER PUBLICATIONS

"Neodol", (Shell), Apr. 1981.
Schick, Ed., "Nonionic Surfactants", (1967), pp. 427, 428, 429; 630.

*Primary Examiner*—Paul Lieberman
*Assistant Examiner*—John F. McNally
*Attorney, Agent, or Firm*—James J. Farrell

[57] ABSTRACT

A detergent composition for softening fabrics while maintaining good detergency comprises a fatty amine such as di tallow methyl tertiary amine and a nonionic surfactant with a low cloud point, such as an ethoxylated fatty alcohol with 3 moles of ethylene oxide per molecule.

8 Claims, No Drawings

COMPOSITION FOR SOFTENING FABRICS

This invention relates to a composition for softening fabrics and in particular to such a composition which is capable of imparting a softening benefit to fabrics during a wash process.

A number of materials have been suggested in the art for providing softening-in-the-wash benefits. These include certain classes of fatty amines, especially tertiary amines. Thus GB No. 1514276 teaches the use of certain long chain tertiary amines that are nonionic in character at the wash liquor pH existing when a conventional laundry detergent is used.

A common problem with detergent compositions which are intended to both clean and soften fabrics is that the inclusion of the fabric softening agent is detrimental to cleaning performance.

We have found that, when a fatty amine is used as the fabric softening agent, cleaning performance can be improved by the inclusion in the composition of certain nonionic surfactant materials, without detriment to softening performance, while in some cases softening performance is enhanced.

Thus according to the invention there is provided a detergent composition comprising:

(i) a surfactant system and (ii) a fatty amine fabric softening agent, wherein the surfactant system includes a nonionic surfactant or mixture thereof which has a cloudy phase at 1% concentration in water at a temperature somewhere between 0° C. and 40° C.

The nonionic surfactant systems useful in the present invention have a cloudy phase somewhere in the temperature range of 0° C. to 40° C., preferably 0° C. to 15° C. in distilled water at 1% concentration. In practise this means that the system has a cloud point of not more than 40° C., preferably not more than 15° C. Cloud point is a term well known in the art, for example from Surface Active Ethylene Oxide Addicts by N. Schonfeldt, Pergamon Press 1969, pp 145 to 154. In general terms the cloud point of a surfactant material is the temperature at which association between the surfactant and water molecules through hydrogen bonding breaks down, leading to the separation of surfactant rich and water rich phases and a consequential increase in turbidity or cloudiness.

The cloud point correlates approximately to the hydrophilic-lipophilic balance (HLB) of the surfactant system and it is therefore preferred that the HLB should be less than 10.5, such as not more than 9.5.

The HLB should preferably be above 6.0, most preferably above 8.0 to provide sufficient detergency.

Suitable nonionic detergent compounds which may be used include in particular the reaction products of compounds having a hydrophobic group and a reactive hydrogen atom, for example aliphatic alcohols, acids, amides or alkyl phenols with alkylene oxides, especially ethylene oxide either alone or with propylene oxide. Specific nonionic detergent compounds are alkyl ($C_6$–$C_{22}$) phenols-ethylene oxide condensates, the condensation products of aliphatic ($C_8$–$C_{18}$) primary or secondary linear or branched alcohols with ethylene oxide, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

Where, for example, alkylene oxide adducts of fatty materials are used as the nonionic detergent compounds, the number of alkylene oxide groups per molecule has a considerable effect upon the cloud point as indicated by the Schonfeldt reference mentioned above. The chain length and nature of the fatty material is also influential, and thus the preferred number of alkylene oxide groups per molecule depends upon the nature and chain length of the fatty material. We have found for example that where the fatty material is a fatty alcohol having about 13 to 15 carbon atoms, the adduct having 3 ethylene oxide groups per molecule has a cloud point of less than 0° C. and is therefore suitable for use in the present invention. A similar surfactant having 7 ethylene oxide groups per molecule has a cloud point of about 48° C. and is thereof ore unsuitable. Further ethoxylation raises the cloud point still higher. Thus the similar surfactant with 11 ethylene oxide groups per molecule has a cloud point higher than 80° C.

Where mixtures of surfactant materials are used, it is the properties of the individual components of the mixture rather than their average properties which are important.

Thus, whilst a mixture of such 3EO and 11EO ethoxylated alcohols may well have an HLB close to that of the 7EO material, the 7EO material alone would give a clear solution below 15° C., passing to a cloudy condition above about 48° C., while the mixture could be cloudy below 15° C. In the context of the present invention therefore, the use of the 7EO material would be unsuitable while the mixture of 3EO and 11EO materials would be suitable.

Where the components of the nonionic surfactant system comprise alkoxylated fatty alochols, it is preferred that the level of the unalkoxylated fatty alcohol is less than 15% of the nonionic surfactant system. This is because the alcohol component is volatile leading to off odour of the product and the risk of environmental pollution if spray-dried. It is also a non-surface active material and when present at higher levels represents significant dilution of the nonionic surfactant system.

The fatty amine fabric softening agent is preferably a tertiary amine although the use of primary or secondary amines is also possible. When it is a tertiary amine, it preferably has the general formula

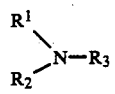

wherein $R_1$ is an alkyl or alkenyl group with 10 to 26 carbon atoms, $R_2$ is as $R_1$ or, if $R_1$ contains 20 to 26 carbon atoms, then $R_2$ may be an alkyl group with 1 to 7 carbon atoms, and $R_3$ has the formula $$CH_2—Y$$

wherein Y is hydrogen, an alkyl group with 1 to 6 carbon atoms, $—C_6H_5$, $—CH_2OH$, $—CH{=}CH_2$, $—C_2H_4OH$, $—CH_2CN$, $—CH_2CO.R_4$, $—CH_2CO.N(R_5)_2$ or $—C_2H_4N(R_5)_2$ wherein $R_4$ is an alkyl group with 1 to 4 carbon atoms, each $R_5$ is independently hydrogen or an alkyl group with 1 to 20 carbon atoms. The most preferred tertiary fatty amines are selected from di $—C_{1-6}$–$C_{22}$ alkyl $C_1$–$C_4$ alkyl amines in which the fatty alkyl chains are derived from animal fats. Suitable amines include:

di decyl methylamine
di lauryl methylamine
di myristyl methylamine
di cetyl methylamine
di stearyl methylamine
di arachadyl methylamine
di behenyl methylamine
arachidyl behenyl methylamine or
di (mixed arachidyl/behenyl) methylamine
di (cocoyl) methylamine
di (tallowyl) methylamine
arachidyl/behenyl dimethylamine and the corresponding ethyl amines, propylamines and butylamines. Especially preferred is ditallowyl methylamine. This is commercially available as Armeen M2HT from Akzo N.V. as Genamin SH301 from Farbwerke Hoechst, and as Noram M2SH from the CECA Company.

didecyl benzylamine
dilauryl benzylamine
dimyristyl benzylamine
dicetyl benzylamine
distearyl benzylamine
dioleyl benzylamine
dilinoleyl benzylamine
diarachidyl benzylamine
dibehenyl benzylamine
di (arachidyl/behenyl) benzylamine
di (cocoyl) benzylamine
di (tallowyl) benzylamine and the corresponding allylamines, hydroxy ethylamines, hydroxy propylamines, and 2-cyanoethylamines. Especially preferred are ditallowyl benzylamine and ditallowyl allylamine.

The primary and secondary amines suitable for the purpose of the invention are water-insoluble compounds having the general formula:

$$R_1R_2NH$$

wherein $R_1$ is a $C_{12}$–$C_{26}$ alkyl or alkenyl group and $R_2$ is H or a $C_1$–$C_7$ alkyl, or a $C_{12}$–$C_{26}$ alkyl or alkenyl group.

Preferred amines are primary amines of the above formula wherein $R_1$ is a $C_{12}$–$C_{22}$ or alkenyl group and $R_2$=H, which can be used as such or as their salts.

Examples of suitable amines include:

primary tallow amine
primary palmityl amine
primary stearyl amine
primary oleyl amine
primary coconut amine
primary behenyl amine
secondary di-lauryl amine
secondary distearyl amine
secondary tallow methyl amine
primary tallow amine hydrochloride
primary tallow amine acetate.

Mixtures of any of these amines may be used.

Especially preferred are primary $C_{12}$–$C_{22}$ alkyl/alkenyl amines containing more than 50% of $C_{16}$–$C_{22}$ alkyl-/alkenyl amines, which are commercially available as Armeen 16D, Armeen HT, Armeen HTD, Armeen 18, Armeen 18D, Armeen T and Armeen TD from Armour Chemical Industries Ltd. and as Noram ®S, Noram SH and Noram 42 from the CECA Company.

The surfactant system may include other surfactant materials in addition to the specified nonionic materials. These other surfactant materials may be selected from anionic detergent active materials, zwitterionic or amphoteric detergent active materials or mixtures thereof The anionic detergent active materials are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced for example from tallow or coconut oil, sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty monoglyceride sulphates and sulphonates; sodium and potassium salts of sulphuric acid esters of higher ($C_{8-C18}$) fatty alcohol-alkylene oxide, particularly ethylene oxide, reaction products; the reaction products of fatty acids such as coconut fatty acids esterified with isethionic acid and neutralised with sodium hydroxide; sodium and potassium salts of fatty acid amides of methyl taurine; alkane monosulphonates such as those derived by reacting alpha-olefin ($C_8$–$C_{20}$) with sodium bisulphite and those derived from reacting paraffins with $SO_2$ and $Cl_2$ and then hydrolysing with a base to produce a random sulphonate; and olefin sulphonates, which term is used to describe the material made by reacting olefins, particularly $C_{10}$–$C_{20}$ alpha-olefins, with $SO_3$ and then neutralising and hydrolysing the reaction product. The preferred anionic detergent compounds are sodium ($C_{11}$–$C_{15}$) alkyl benzene sulphonates and sodium ($C_{16}$–$C_{18}$) alkyl sulphates.

The compositions of the invention may contain a detergency builder material, which may be any material capable of reducing the level of free calcium ions in the wash liquor and which will preferably provide the composition with other beneficial properties such as the generation of an alkaline pH, the suspension of soil removed from the fabric and the dispersion of the fabric softening fatty amine.

Examples of phosphorus-containing inorganic detergency builders, when present, include the water-soluble salts, especially alkali metal pyrophosphates, orthophosphates, polyphosphates and phosphonates. Specific examples of inorganic phosphate builders include sodium and potassium tripolyphosphates, ortho phosphates and hexametaphosphates.

Examples of non-phosphorus-containing inorganic detergency builders, when present, include water-soluble alkali metal carbonates, bicarbonates, silicates and crystalline and amorphous alumino silicates. Specific examples include sodium carbonate (with or without calcite seeds), potassium carbonate, sodium and potassium bicarbonates and silicates.

Examples of organic detergency builders, when present, include the alkali metal, ammonium and substituted ammonium polyacetates, carboxylates, polycarboxylates, polyacetyl carboxylates and polyhydroxsulphonates. Specific examples include sodium, potassium, lithium, ammonium and substituted ammonium salts of ethylenediaminetetraacetic acid, nitrilotriacetic acid, oxydisuccinic acid, melitic acid, benzene polycarboxylic acids and citric acid.

Apart from the ingredients already mentioned, a number of optional ingredients may also be present.

Examples of other ingredients which may be present in the composition include other fabric softening agents such as fabric softening clay materials, lather boosters such as alkanolamides, particularly the monoethanolamides derived from palm kernel fatty acids and coconut fatty acids, later depressants, oxygen-releasing bleaching agents such as sodium perborate and sodium percabonate, peracid bleach precursors, chlorine-releasing bleaching agents such as tricloroisocyanuric acid, inorganic salts such as sodium sulphate, and, usually present in very minor amounts, fluorescent agents, perfumes, enzymes such as proteases, lipases and amylases, germicides and colourants.

Preferred compositions according to the invention include from 2% to 50%, such as from 4% to 30% by weight of the surfactant system, the specified nonionic materials occupying from 1% to 15% such as from 1.5% to 10% by weight, from 0.5% to 15%, such as from 1% to 10% by weight of the fabric softening fatty amine, up to 80% by weight, such as from 30% to 60% by weight of a detergency builder, and the balance being made up of optional ingredients and water. These percentages are based on the weight of the overall composition.

The compositions of the invention may be in any physical form such as powders, liquids, pastes or bars.

The detergent compositions according to the invention may be prepared by a number of different methods according to their physical form. In the case of granular products they may be prepared by dry-mixing or coagglomeration. A preferred physical form is a granule incorporating a detergency builder salt and this is most conveniently manufactured by spray-drying at least part of the composition. In this process a slurry is prepared containing the heat-insensitive components of the composition such as the surfactant system, builder material and filler salt. The slurry is spray-dried to form base powder granules with which any solid heat-sensitive ingredients may be mixed, such ingredients including bleaches and enzymes. Although the fatty amine may be included in the slurry for spray-drying, it may degrade under certain processing conditions and adversely affect product quality. In any case, when other ingredients capable of complexing with the amine are present the amine should be added in such a manner that such complexation is substantially prevented so that the amine as such is present in the final product. Thus, when fabric softening clays are present the amine should not be added as a preformed amine/clay complex. It is therefore preferred that the fatty amine be liquified by melting or solvent dissolution and that this liquid be sprayed onto the base powder granules.

The specified nonionic surfactants can also be incorporated in this way, rather than including them in the slurry for spray-drying.

The invention will now be described in more detail in the following non-limiting examples.

EXAMPLE 1

Detergent compositions were prepared by dry-mixing the specified ingredients according to the following approximate formulations.

| Example No | 1A* | 1B* | 1C |
|---|---|---|---|
| Ingredients (parts by weight) | | | |
| Anionic detergent active | 9.0 | 9.0 | 9.0 |
| Nonionic active A7[1] | 4.0 | 4.0 | — |
| Nonionic active A4[2] | — | — | 4.0 |
| Burkeite | 8.0 | — | — |
| Burkeite/amine[3] | — | 10.0 | 10.0 |
| Sodium tripolyphosphate | 25.0 | 25.0 | 25.0 |
| Sodium sulphate | 32.0 | 32.0 | 32.0 |
| Clay[4] | 8.0 | 8.0 | 8.0 |
| *comparative example | | | |

NOTES
[1]Synperonic A7 (ex ICI) which is a $C_{13}$–$C_{15}$ alcohol ethoxylated with approximately 7 moles of ethylene oxide per molecule and having a cloud point of 48° C.
[2]Syperonic A4 (as A7 but containing an average of four moles of ethylene oxide per molecule) and having a cloud point below 0° C.
[3]1 part dihardened tallow methyl tertiary amine carried on 4 parts Burkeite.
[4]ASB1.7 (ex English China Clay) in the form of granulated calcium montmorillonite from Morocco.

It will be seen that the surfactant system in comparative Examples 1A and 1B contains 4 parts A7, while in Example 1C according to the invention 4 parts A4 is present.

In order to compare the detergency performance of these formulations, they were used to wash fabrics under the following conditions:

| | |
|---|---|
| Dosage | 6g/l |
| Water hardness | 24° FH. |
| Wash temperature | 40° C. |
| Fabrics | Artifically soiled cotton and polyester test pieces |
| Wash time | 30 minutes |
| Rinse | 3 × 5 minutes |

After line drying the reflectance of each test piece was measured and compared with the unwashed test piece to generate a value of ΔR. The results were as follows, higher values of ΔR being indicative of better detergency.

| Example No | 1A* | 1B* | 1C |
|---|---|---|---|
| ΔR | | | |
| Cotton | 14.4 | 14.9 | 15.2 |
| Polyester | 6.5 | 5.8 | 8.1 |

It will be seen that the addition of 2 parts amine in Example 1B, compared with 1A, leads to a fall off in detergency on polyester with no significant difference on cotton. The replacement of A7 in Example 1B by A4 in Example 1C leads to an improvement in detergency.

In a separate experiment desized terry towelling pieces were washed under the same conditions and after drying were judged for softness by a panel of experienced assessors who expressed the following aggregated preferences.

| Example No | 1A* | 1B* | 1C |
|---|---|---|---|
| Preferences (maximum 36) | 6 | 19 | 22 |

These results show that the addition of 2 parts amine in Example 1B, compared with 1A, leads to an improvement in softening and that this improvement is more than maintained when the A7 in Example 1B is replaced by A4 in Example 1C.

EXAMPLES 2 AND 3

Example 1 was repeated with the modification that 20 parts and 30 parts of the Burkeite/amine mixture were used respectively in Examples 2 and 3, the level of sodium sulphate being reduced accordingly. The results were:

| Example No | 2A* | 2B* | 2C | 3A* | 3B* | 3C |
|---|---|---|---|---|---|---|
| Amine level (parts) | — | 4.0 | 4.0 | — | 6.0 | 6.0 |
| ΔR Cotton | 15.2 | 14.4 | 16.5 | 15.0 | 13.4 | 15.1 |
| ΔR Polyester | 6.1 | 5.6 | 8.4 | 9.2 | 6.4 | 10.9 |
| Softening (preferences) | 4 | 16 | 32 | 0 | 18 | 30 |

These results show that even at 6 parts amine present, the detergency benefit of the invention is still to be found.

Not only that, in these examples the softening performance itself is significantly enhanced.

EXAMPLES 4 to 8

Example 2 was repeated using a range of different nonionic surfactants, using the compositions from Examples 2A* and 2B* for comparison. Details of the nonionic surfactants and the results obtained were as follows:

| Example No | 2A* | 2B* | 4 | 5 | 6 | 7 | 8 |
|---|---|---|---|---|---|---|---|
| Amine (%) | — | 4.0 | 4.0 | 4.0 | 4.0 | 4.0 | 4.0 |
| Nonionic | A7 | A7 | A6/A7 | A6 | A5 | A4 | A3 |
| Cloud point (°C.) (approx) | 48 | 48 | 36 | 30 | 12 | <0 | <0 |
| ΔR (Cotton) | 16.0 | 15.0 | 16.3 | 16.2 | 16.2 | 15.8 | 16.3 |
| ΔR (Polyester) | 6.2 | 5.7 | 6.2 | 6.2 | 7.7 | 7.5 | 9.0 |
| Softening preference | 24 | 51 | 56 | 51 | 45 | 45 | 59 |

It is clear from these results that the inclusion of amine consistently improves softening performance and while comparison between the cleaning performance of Examples 2A* and 2B* shows the amine to have a disadvantageous effect, the replacement of the A7 nonionic surfactant with a surfactant system having a cloud point below 40° C. restores and even improves cleaning performance.

EXAMPLE 9

Detergent compositions were prepared by dry-mixing the specified ingredients according to the following approximate formulations, using the same amine as used in Example 1.

| Example No | 9A* | 9B |
|---|---|---|
| Ingredients (parts by weight) | | |
| Anionic detergent active | 9.0 | 9.0 |
| Nonionic active A7 | 4.0 | — |
| Nonionic active A4 | — | 4.0 |
| Burkeite/amine | 20.0 | 20.0 |
| Sodium tripolyphosphate | 25.0 | 25.0 |
| Sodium sulphate | 24.0 | 24.0 |

In order to compare the detergency performance of these formulations, they were tested in the same manner as described in Example 1. The results were as follows:

| Example No | 9A* | 9B |
|---|---|---|
| ΔR | | |
| Cotton | 12.7 | 14.4 |
| Polyester | 6.9 | 7.6 |

These results serve to confirm the benefit of replacing the nonionic surfactant A7 in Example 9A* with A4.

EXAMPLES 10 TO 13

The following liquid formulations are useful examples of compositions according to the invention.

| Example No | 10 | 11 | 12 | 13 |
|---|---|---|---|---|
| Ingredients (% by weight) | | | | |
| Sodium linear alkyl benzene sulphonate | 7.0 | 7.0 | 8.4 | 8.4 |
| Lauryl ether sulphate (3EO) | — | — | 3.0 | 3.0 |
| Nonionic surtactant A3 | 3.0 | 3.0 | 2.6 | 2.6 |
| Potassium oleate soap | 1.0 | 1.0 | — | — |
| Sodium tripolyphosphate | 22.8 | 22.8 | — | — |
| Zeolite | — | — | 16.0 | 16.0 |
| Acrylate/maleate copolymer | — | — | 3.5 | 3.5 |
| Sodium citrate | — | — | 2.0 | 2.0 |
| Glycerol | 4.85 | 4.85 | 7.0 | 7.0 |
| Borax | 3.1 | 3.1 | 6.0 | 6.0 |
| Proteolytic enzyme | 0.5 | 0.5 | 0.5 | 0.5 |
| Hardened tallow primary amine | 2.0 | — | 2.0 | — |
| Dihardened tallow methyltertiaryamine | — | 2.0 | — | 2.0 |
| Water and minor ingredients | | | balance | |

EXAMPLES 14 TO 17

The following powder formulations are useful examples of compositions according to the invention.

| Example No | 14 | 15 | 16 | 17 |
|---|---|---|---|---|
| Ingredients (% by weight) | | | | |
| Anionic detergent active | | | 9.0 | |
| Nonionic surfactant A7 | 1.0 | 1.0 | — | — |
| Nonionic surfactant A4 | — | — | 4.0 | 4.0 |
| Nonionic surfactant A3 | 2.0 | 2.0 | — | — |
| Sodium tripolyphosphate | | | 23.0 | |
| Sodium carbonate | | | 6.0 | |
| Sodium alkaline silicate | | | 5.5 | |
| Sodium sulphate | | | 30.8 | |
| Hardened tallow primary amine | 1.0 | — | 1.0 | 2.0 |
| Dihardened tallow methyltertiaryamine | — | 1.0 | — | — |
| Water and minor ingredients | | | balance | |

We claim:

1. A detergent composition capable of imparting a softening benefit to fabrics during a wash process, comprising:

(i) from 2% to 50% by weight of a surfactant system selected from the group consisting of:

(a) from at least 1% to 15% of at least one nonionic surfactant, and (b) mixtures of 1% to 15% of at least one nonionic surfactant with a further surfactant selected from anionic, zwitterionic and amphoteric detergent active material mixtures thereof, said at least one nonionic surfactant having a cloud point of not more than 40° C. at 1% concentration in distilled water and an HLB of not more than 9.5.

(ii) from 0.5% to 15% by weight of a fatty amine fabric softening agent selected from the group consisting of primary amines, secondary amines and tertiary amines; and (iii) up to 80% by weight of a detergency builder.

2. A composition according to claim 1, wherein said at least one nonionic surfactant has a cloud point of not more than 15° C. at 1% concentration in distilled water.

3. A composition according to claim 1, wherein said at "least one nonionic surfactant has an HLB above 6.0.

4. A composition according to claim 1, wherein said at least one nonionic surfactant has an HLB of from 8.0 to 9.5.

5. A composition according to claim 1, wherein said fatty amine fabric softening agent is selected from primary and tertiary fatty amines.

6. A composition according to claim 1, further comprising a fabric softening clay material.

7. A composition according to claim 1, wherein said at least one nonionic surfactant is selected from condensation products of aliphatic ($C_8$–$C_{18}$) alcohols with less than 7 ethylene oxide groups per molecule.

8. The composition according to claim 1 wherein the builder comprises from 30 to 60% by weight of the composition.

* * * * *